US006058630A

United States Patent [19]

Brown

[11] Patent Number: 6,058,630

[45] Date of Patent: May 9, 2000

[54] FLUID SEAL FOR MAINTAINING VACUUM

[76] Inventor: Raymond C. Brown, 66 Monroe St., Keyport, N.J. 07735

[21] Appl. No.: 09/368,944

[22] Filed: Aug. 5, 1999

Related U.S. Application Data

[63] Continuation-in-part of application No. 08/876,767, Jun. 16, 1997, abandoned.

[51] Int. Cl.[7] ..... E02F 3/88

[52] U.S. Cl. ..... 37/322; 37/323

[58] Field of Search ..... 37/317, 318, 321, 37/322, 323, 195; 299/8, 9, 17; 175/66, 424, 324, 213; 406/88, 96, 162, 153, 157

[56] References Cited

U.S. PATENT DOCUMENTS

| | | | |
|---|---|---|---|
| 1,444,069 | 2/1923 | Gyger | 37/322 X |
| 2,019,968 | 11/1935 | Holloway | 37/322 |
| 3,457,863 | 7/1969 | Carter | 37/322 X |
| 4,322,897 | 4/1982 | Brassfield | 37/322 |
| 4,991,321 | 2/1991 | Artzberger | 37/322 |

*Primary Examiner*—Robert E. Pezzuto
*Attorney, Agent, or Firm*—Robert M. Skolnik

[57] ABSTRACT

A suction, or vacuum, is created by the coupling of two sections of tubing of dissimilar size. The larger section of tubing has an open ended reservoir attached to one end thereof. The smaller section of tubing has an end plate attached at a point approximately one third of its length. The longer portion of the smaller section of tubing is inserted into the larger tube until the end plate mated to the reservoir. A fluid medium such as water or air is pumped into the reservoir under high pressure filling the reservoir and encompassing the inner section of tubing. The space between the smaller section of tubing and the larger section of tubing is fluidly coupled to the reservoir. The application of the pressurized fluid medium from the reservoir to the space between the sections of tubing creates a low pressure within the inner tubing resulting in a vacuum or suction being effected at the intake of the inner tubing.

2 Claims, 2 Drawing Sheets

FLUID SEAL FOR MAINTAINING VACUUM

CROSS REFERENCE TO RELATED APPLICATIONS

This Application is a continuation-in-part of my copending application Ser. No. 08/876,767, filed Jun. 16, 1997, now abandoned.

BACKGROUND OF THE INVENTION

1. Field of the Invention

This invention relates to a suction device for creating a vacuum to remove materials from one location and deposit them at another location. The materials may be solids, gases, liquids or slurries.

2. Description of the Prior Art

Beck, U.S. Pat. No. 4,409,746 discloses a dredge having a circular chamber into which high pressure fluid is pumped. A fluid outlet is also attached to the chamber. A vortex is created in the chamber at the location of intermitting pipes. The space between the pipes is employed as a low-pressure outlet so that the smaller of the pipes is fluidly coupled to the low-pressure vortex thereby causing fluid and materials to be suctioned into the chamber and exited through the outlet.

SUMMARY OF THE INVENTION

A suction, or vacuum, is created by the fluid coupling of two sections of tubing of dissimilar size. The larger section of tubing has an open ended reservoir attached to one end thereof The smaller section of tubing has an end plate attached at a point approximately one third of its length. The longer portion of the smaller section of tubing is inserted into the larger tube until the end plate mated to the reservoir. A fluid medium such as water or air is pumped into the reservoir under high pressure filling the reservoir and encompassing the inner section of tubing. The space between the smaller section of tubing and the larger section of tubing is fluidly coupled to the reservoir. The application of the pressurized fluid medium from the reservoir to the space between the sections of tubing creates a low pressure within the inner tubing resulting in a vacuum or suction being effected at the intake of the inner tubing.

A principal object and advantage of the present invention is the provision of a device for creating a vacuum. A still further object and advantage of the invention is the provision of device which uses high pressure fluid input which creates a vacuum at the outlet of an inner tube. Another object and advantage of the invention is the provision of device which uses relies on the application of pressurized fluid to a confined space between two tubes to create an area of low pressure at the outlet of the inner tube. Another object and advantage of the invention is the provision of suction system which will maintain suction so long as the ambient pressure at the inlet is less than the pressure created at the outlet of the inner tube. Another object and advantage of the invention is the provision of a device which creates a vacuum using a source of controlled fluid pressure so that the vacuum is maintained without reliance on the materials which are being suctioned.

BRIEF DESCRIPTION OF THE DRAWINGS

These as well as further objects and advantages of the invention will become apparent to those skilled in the art from a review of the following detailed specification of my invention reference being made to the accompanying drawings in which.

DESCRIPTION OF THE PREFERRED EMBODIMENTS

Figure 1:
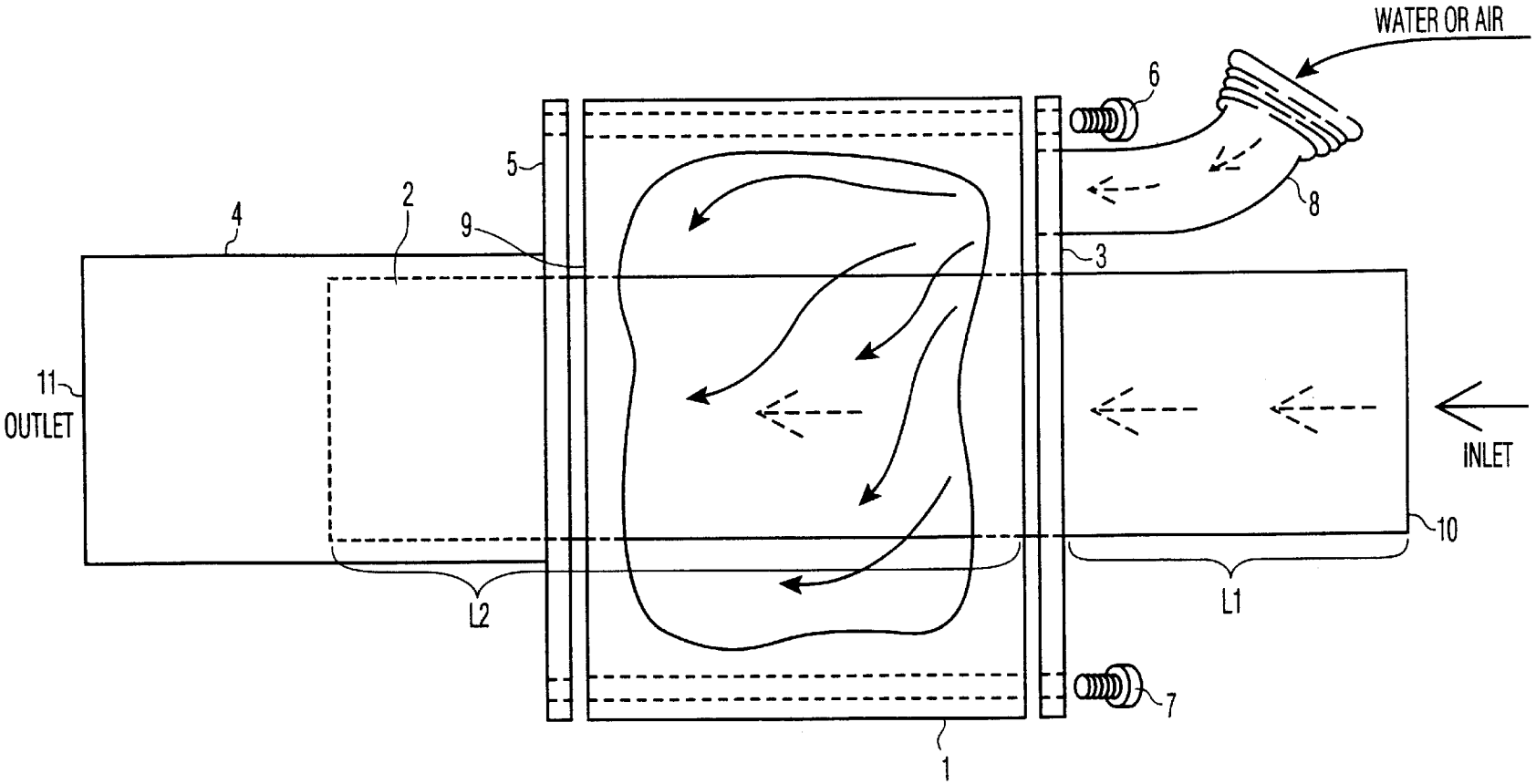
FIG. 1 is an assembly view of a portion of the apparatus of my invention.

As shown in FIG. 1, the invention includes a chamber 1 having a longer section of tubing 2 mounted therein. The section of tubing 2 has a flange 3 formed along the length of the tubing so that the length of the portion L1 (the inlet) is approximately ⅓ of the total length of the tubing 2 and the length of the portion L2 (the outlet) is approximately ⅔ of the total length of the tubing 2. Approximately ⅓ of the length of the tubing 2 extends beyond flange 5. A larger diameter tubing 4 has a flange 5 formed at one end thereof so that the tubing 4 can be attached to the wall of the chamber 1. The tubing 4 fits over the entire exposed length of the outlet tubing 2 and extends beyond the end of the outlet of tubing 2.

Approximately ⅓ of the length of the inner tube 2 is covered by the outer tube 4 at the material outlet portion 11 in FIG. 1. The chamber and the two sections of tubing can be attached as by bolts 6, 7 or other conventional fastening devices. A fluid inlet 8 is attached to the chamber 1.

Figure 2:
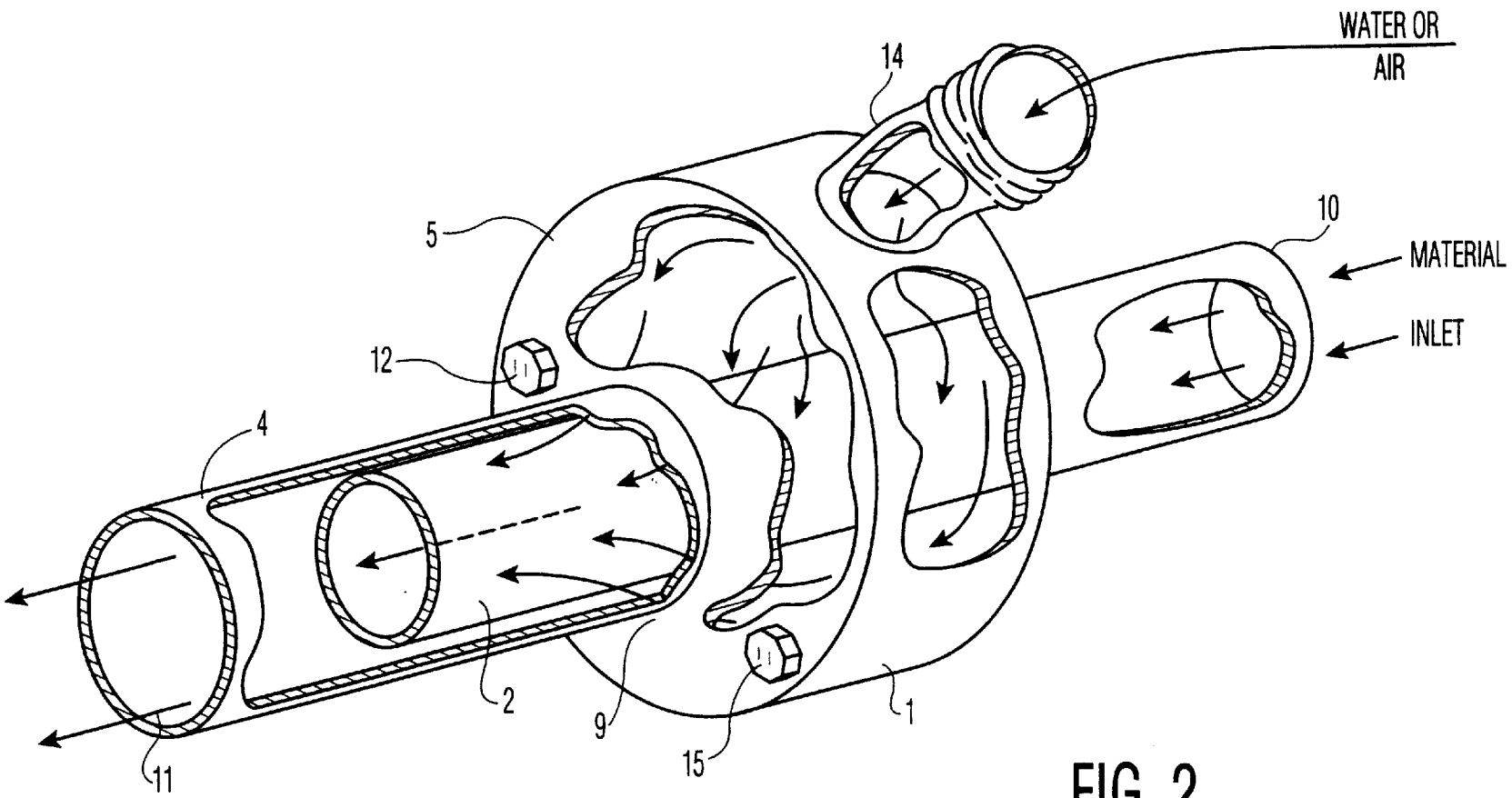
FIG. 2 is a perspective view of another version of the apparatus of my invention.

As shown in FIG. 2, the diameter of the output aperture 9 of the chamber 1 is equal to the inner diameter of the tubing 4 so that a fluid path is provided between the outer wall of tube 2 and the inner wall of the tube 4. Approximately ½ of the length of the inner tube 2 may be used to provide this fluid path. In addition, FIG. 2 shows an inlet 14 mounted on the sidewall of the reservoir 1. Also, bolts 12 and 13 may be used in lieu of opposite facing bolts 6 and 7 of FIG. 1. The other elements of FIG. 2 are the same as described in connection with the embodiment of FIG. 1.

As will now be seen, the device of FIGS. 1–2 operates when pressurized fluid such as air or water is applied to inlet 8 filling chamber 1. A portion of the pressurized fluid in chamber 1 is forced to exit the chamber at output aperture 9 filling the space between the tubing 2 and the tubing 4. The effects of the pressure of the fluid in chamber 1 and the velocity of the fluid in the space between the tubes creates a low pressure at the location V. The effect of the low pressure V is to suction materials, fluids, etc. at inlet 10 though the tubes 2 and 4 to outlet 11.

The important feature of the present invention is its ability to maintain low pressure at location V (and thereby suction at inlet 10) so long as the pressure at location V is lower than the pressure at inlet 10. Suction at inlet 10 is maintained, for example, if the inlet 10 is initially placed in a fluid (and is being used as a dredge), then, the inlet is inadvertently or intentionally moved from the fluid to a location out of the fluid and into an area of different pressure.

Further suction can be provided at the outlet 11, as required, to remove and relocate the materials from inlet 10 and outlet 11 to other locations or processes.

Further modifications to the method and apparatus of the invention may be made without departing from the spirit and scope of the invention; accordingly, what is sought to be protected is set forth in the appended claims.

I claim:

1. An excavation suctioning device comprising a cylindrical reservoir having a fluid inlet tube, the reservoir for receiving pressurized fluid; a first tube connected to said reservoir, said first tube having a material inlet portion, a central portion and a material outlet portion, said central portion of said first tube being located within and in parallel spaced relationship to said reservoir; a second tube, said second tube having an open end located axially opposed to the reservoir and a connection end operably connected to said reservoir, said second tube surrounding substantially ⅓ of the length of said material outlet portion of said first tube and thereby forming an elongated space between said second tube and said material outlet portion of said first tube; a means coupling said reservoir and said space to permit a fluid output of said reservoir to flow into said space to thereby lower the pressure of said fluid at said material output portion relative to the pressure at said material inlet portion, the diameter of said first tube being smaller than the diameter of said second tube; and wherein the reservoir, first tube and second tube have relative locations to be axially aligned.

2. A method of excavating material from one location to another location, the method including the steps of:

providing a suctioning device;

the suctioning device comprising a cylindrical reservoir having a fluid inlet tube, the reservoir for receiving pressurized fluid; a first tube connected to said reservoir, said first tube having a material inlet portion, a central portion and a material outlet portion, said central portion of said first tube being located within and in parallel spaced relationship to said reservoir; a second tube, said second tube having an open end located axially opposed to the reservoir and a connection end operably connected to said reservoir, said second tube surrounding substantially ⅓ of the length of said material outlet portion of said first tube and thereby forming an elongated space between said second tube and said material outlet portion of said first tube; a means coupling said reservoir and said space to permit a fluid output of said reservoir to flow into said space to thereby lower the pressure of said fluid at said material output portion relative to the pressure at said material inlet portion, the diameter of said first tube being smaller than the diameter of said second tube; and wherein the reservoir, first tube and second tube have relative locations to be axially aligned;

orienting the material inlet portion of the first tube towards the material to be excavated; and, orienting the open end of the second tube in the location of desired material deposit.

* * * * *